US011557883B2

(12) United States Patent
Shono et al.

(10) Patent No.: US 11,557,883 B2
(45) Date of Patent: Jan. 17, 2023

(54) IGNITION DEVICE

(71) Applicant: DIAMOND&ZEBRA ELECTRIC MFG. CO., LTD., Osaka (JP)

(72) Inventors: Atsushi Shono, Osaka (JP); Hiroshi Oshiumi, Osaka (JP); Takushi Nishimura, Osaka (JP)

(73) Assignee: DIAMOND & ZEBRA ELECTRIC MFG. CO., LTD., Osaka (JP)

( * ) Notice: Subject to any disclaimer, the term of this patent is extended or adjusted under 35 U.S.C. 154(b) by 373 days.

(21) Appl. No.: 17/007,991

(22) Filed: Aug. 31, 2020

(65) Prior Publication Data

US 2021/0203136 A1 Jul. 1, 2021

(30) Foreign Application Priority Data

Dec. 27, 2019 (JP) ..... JP2019-237952

(51) Int. Cl.

| | |
|---|---|
| ***H01F 38/12*** | (2006.01) |
| ***H01F 27/28*** | (2006.01) |
| ***H01T 15/00*** | (2006.01) |
| ***H01F 27/32*** | (2006.01) |
| ***F02P 3/02*** | (2006.01) |

(52) U.S. Cl.

CPC ..... *H01T 15/00* (2013.01); *F02P 3/02* (2013.01); *H01F 27/325* (2013.01); *H01F 38/12* (2013.01)

(58) Field of Classification Search

CPC ..... H01T 15/00; H01F 27/325; H01F 38/12; H01F 2038/122; H01F 27/2852; H01F 27/2828; F02P 3/02

See application file for complete search history.

(56) References Cited

U.S. PATENT DOCUMENTS

2019/0311849 A1* 10/2019 Idogawa ..... H01F 38/12

FOREIGN PATENT DOCUMENTS

JP 6448010 B2 1/2019

* cited by examiner

*Primary Examiner* — Jacob M Amick

(74) *Attorney, Agent, or Firm* — McDermott Will & Emery LLP

(57) ABSTRACT

An ignition device includes a coil unit and an igniter. The coil unit includes a primary coil and a secondary coil. The primary coil includes a main primary coil and an auxiliary primary coil formed by winding a single primary conductor on a primary bobbin. The secondary coil is formed by winding a secondary conductor on a secondary bobbin. A DC voltage is applied to an intermediate section of the primary conductor between the main primary coil and the auxiliary primary coil. The igniter controls current flowing into the main primary coil or the auxiliary primary coil. The primary bobbin includes a bobbin body and a hooking part protruding from the bobbin body. The main primary coil and the auxiliary primary coil are wound on an outer peripheral surface of the bobbin body to the same direction. A part of the intermediate section is hooked on the hooking part.

10 Claims, 11 Drawing Sheets

IGNITION DEVICE

RELATED APPLICATIONS

This application claims the benefit of Japanese Application No. 2019-237952, filed on Dec. 27, 2019, the disclosure of which is incorporated by reference herein.

BACKGROUND OF THE INVENTION

Field of the Invention

The present invention relates to an ignition device for use in an internal combustion engine.

Description of the Background Art

A vehicle body such as that of an automobile is conventionally provided with an ignition device for use in an internal combustion engine. The coil unit of the ignition device increases a DC low voltage supplied from a battery to as high as some thousands of volts under control by an engine control unit (ECU), and supplies the increased voltage to a spark plug. By doing so, an electric spark is generated to ignite fuel. An example of the conventional ignition device is disclosed in Japanese Patent No. 6448010, for example.

Japanese Patent No. 6448010 discloses an ignition device (1) for use in an internal combustion engine having an ignition coil (10) including a main primary coil (110) and an auxiliary primary coil (120). The main primary coil (110) interrupts a current at the predetermined timing after start of current passage to generate magnetic flux change of reducing a magnetic flux content. Then, a current is passed through the auxiliary primary coil (120) at optional timing after generation of the magnetic flux change to generate additional magnetic flux in the same direction as the direction of the magnetic flux change. Adjusting timing of generation of the additional magnetic flux or adjusting a duration of the additional magnetic flux using the auxiliary primary coil (120) causes discharge energy generated at a secondary coil (200) to follow a discharge pattern suitable for an internal combustion engine, thereby maintaining stable combustion at the internal combustion engine.

The main primary coil (110) of Japanese Patent No. 6448010 is formed by winding a magnet wire a required number of turns in the right-handed screw direction on a primary coil bobbin (130). Then, the outer surface of the main primary coil (110) is covered by an inner insulating sheet (141) as insulating means, and a magnet wire is wound a required number of turns in the left-handed screw direction on the outer surface of the inner insulating sheet (141), thereby forming the auxiliary primary coil (120). Further, an external insulating sheet (142) is fitted on the outer surface of the auxiliary primary coil (120) to form a primary coil (100A). However, this configuration requires provision of the main primary coil (110) and the auxiliary primary coil (120) separately as different parts. This complicates work including winding and connection to each part, causing a risk of reduction in working efficiency. This further causes a risk of increase in weight or volume of the primary coil (100A) in its entirety.

SUMMARY OF THE INVENTION

The present invention is intended to provide a technique allowing work including winding and connection to each part to be done with increased efficiency and allowing suppression of increase in weight or volume of a primary coil in its entirety including a main primary coil and an auxiliary primary coil during formation of the primary coil.

To solve the foregoing problem, a first aspect of the present invention is intended for an ignition device for use in an internal combustion engine. The ignition device includes: a coil unit with a primary coil, a secondary coil, and an iron core, the primary coil including a main primary coil and an auxiliary primary coil formed by winding a single primary conductor on a primary bobbin, the secondary coil is formed by winding a secondary conductor on a secondary bobbin, the iron core electromagnetically coupling the primary coil and the secondary coil, the coil unit receiving a DC voltage from a power supply at an intermediate section of the primary conductor between the main primary coil and the auxiliary primary coil; a first switch interposed between the main primary coil and the ground and usable for switching between passage and interruption of a primary current flowing from the power supply into the main primary coil; a second switch interposed between the auxiliary primary coil and the ground and usable for switching between passage and interruption of a primary current flowing from the power supply into the auxiliary primary coil; and a controller that controls the first switch and the second switch. The primary bobbin includes: a bobbin body extending in a tubular shape around a part of the iron core; and a hooking part protruding from a part of the bobbin body. The main primary coil and the auxiliary primary coil are wound on an outer peripheral surface of the bobbin body to be pointed to the same direction in a peripheral direction, and one of the main primary coil and the auxiliary primary coil is stacked on the other of the main primary coil and the auxiliary primary coil to be external to the other primary coil in a radial direction. At least a part of the intermediate section is hooked on the hooking part.

According to the first aspect of the present invention, the primary coil is formed by stacking the main primary coil and the auxiliary primary coil on each other each formed by winding the single primary conductor on the primary bobbin. By doing so, work including winding of the primary conductor and connection of the main primary coil and the auxiliary primary coil to corresponding parts is done with increased efficiency. Further, increase in weight or volume of the primary coil in its entirety is suppressed.

DESCRIPTION OF THE PREFERRED EMBODIMENTS

Figure 1:
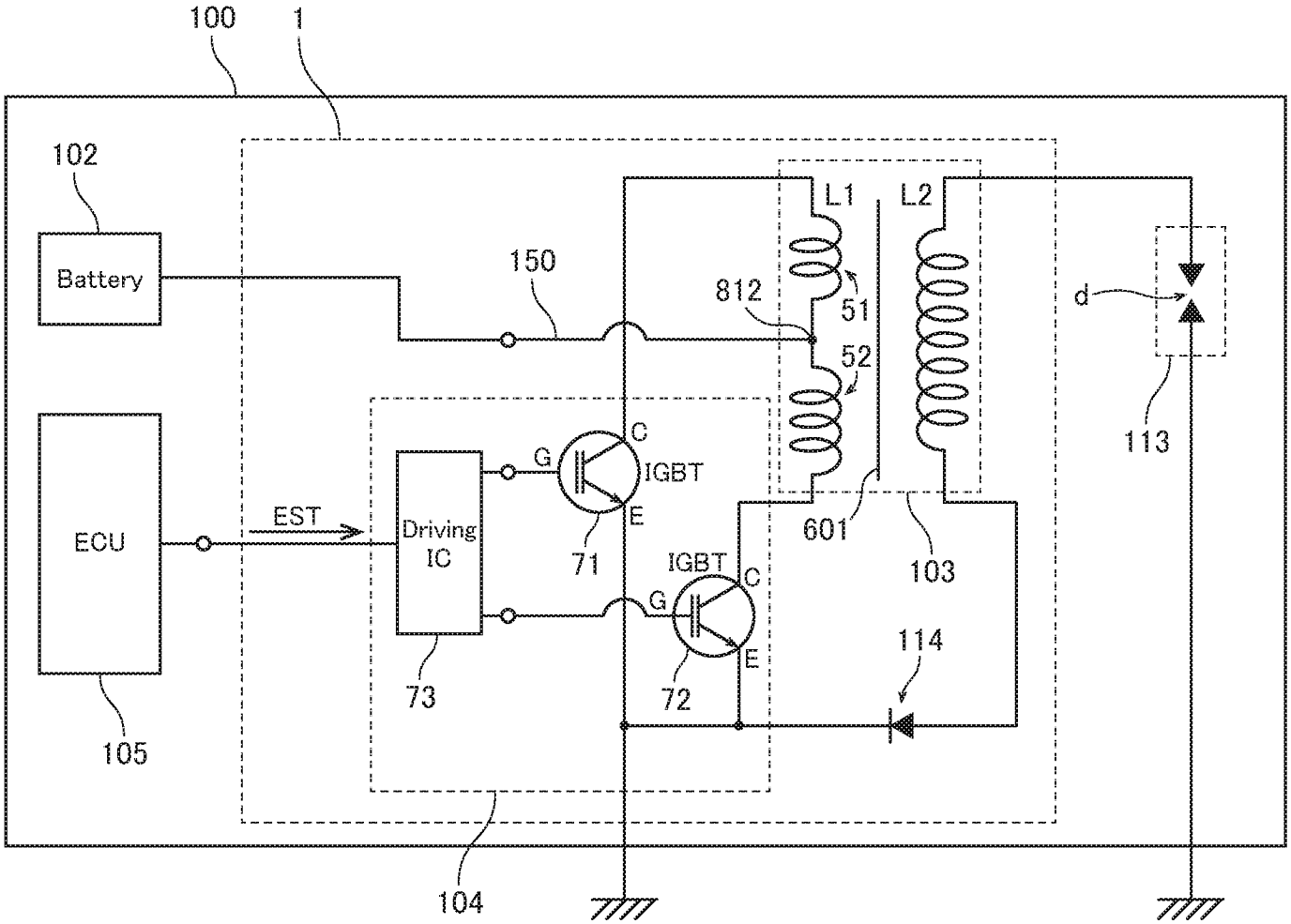
FIG. 1 is a block diagram schematically showing an operating environment of an ignition device according to a first preferred embodiment.

An exemplary preferred embodiment of the present invention will be described below by referring to the drawings. In the present invention, a direction parallel to the center axis of a bobbin body on which a main primary coil and an auxiliary primary coil in a coil unit described later are wound will be called an "axis direction," a direction perpendicular to the center axis of the bobbin body will be called a "radial direction," and a direction along an arc centered on the center axis of the bobbin body will be called a "peripheral direction." In the present invention, for the convenience of description, the shape of each part and the positions of parts relative to each other will be described while the axis direction is defined as an up-down direction, and a protrusion side where an end of a main primary coil and an end of an auxiliary primary coil are tied is defined as an upper side relative to the bobbin body. However, this definition of the up-down direction is not intended to limit the postures of a coil unit and an ignition device according to the present invention during manufacture and during use of the coil unit and ignition device. In the present invention, the "parallel direction" includes a substantially parallel direction. In the present invention, the "perpendicular direction" includes a substantially perpendicular direction.

1. First Preferred Embodiment

<1-1. Configuration of Ignition Device>

The configuration of an ignition device 1 corresponding to a first preferred embodiment of the present invention will be described first by referring to the drawings. FIG. 1 is a block diagram schematically showing an operating environment of the ignition device 1 according to the first preferred embodiment. As described later, a primary coil L1 (including a main primary coil 51 and an auxiliary primary coil 52) and a secondary coil L2 in a coil unit 103 in the ignition device 1 are arranged in directions in which these coils are stacked on each other in the radial direction. To facilitate understanding, however, these coils are illustrated in positions adjacent to each other in FIG. 1.

The ignition device 1 of the first preferred embodiment is a device installed on a vehicle body 100 of a vehicle such as an automobile, for example, and used for applying a high voltage for generating spark discharge at a spark plug 113 for use in an internal combustion engine. As shown in FIG. 1, the vehicle body 100 includes the spark plug 113, a battery 102, and an engine control unit (ECU) 105, in addition to the ignition device 1. The ignition device 1 of the first preferred embodiment includes the coil unit 103 and an igniter 104 described later.

The spark plug 113 is connected to one end of the secondary coil L2 described later in the coil unit 103. When a high voltage is induced in the secondary coil L2 in the coil unit 103, discharge occurs at a gap d in the spark plug 113 to generate a spark. As a result, fuel filling an internal combustion engine is ignited.

The battery 102 is a power supply (storage battery) capable of being charged and discharged with DC power. In the first preferred embodiment, the battery 102 is electrically connected to the primary coil L1 described later in the coil unit 103. The battery 102 supplies a DC voltage to the primary coil L1 in the coil unit 103.

Figure 2:
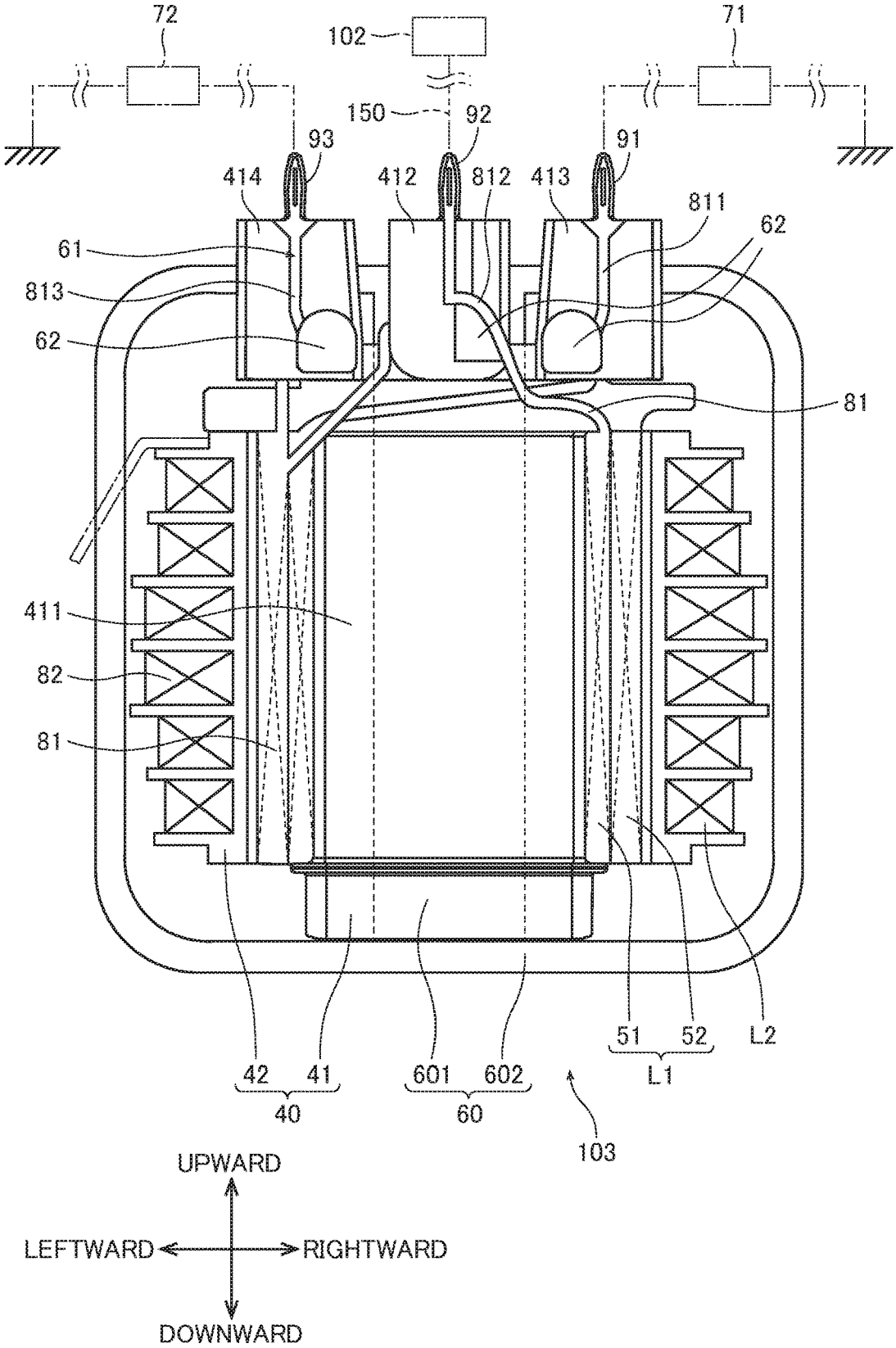
FIG. 2 is a plan view of a coil unit according to the first preferred embodiment.

FIG. 2 is a plan view of the coil unit 103. As shown in FIG. 2, the coil unit 103 includes a bobbin 40, the primary coil L1, the secondary coil L2, and an iron core 60. In FIG. 2, a primary conductor 81 forming the primary coil L1 and a secondary conductor 82 forming the secondary coil L2 described later are illustrated partially in a simplified manner. The coil unit 103 is arranged integrally with the igniter 104 in a coil case provided separately.

As shown in FIG. 1, the main primary coil 51 and the auxiliary primary coil 52 are formed in series with each other in the primary coil L1. An intermediate section 812 is located between the main primary coil 51 and the auxiliary primary coil 52, and a conductor extending from the battery 102 is connected is connected to the intermediate section 812. This conductor extending from the battery 102 will hereinafter be called a "power supply line 150." By doing so, a DC low voltage is applied from the battery 102 to the intermediate section 812. When a first switch 71 or a second switch 72 is closed, a primary current (a primary current I1*a* or a primary current I1*b* described later) starts to flow in the primary coil L1 in such a manner as to increase gradually. The coil unit 103 increases DC low-voltage power supplied from the battery 102 to as high as some thousands of volts, and supplies the high-voltage power to the spark plug 113. Then, an electric spark is generated at the spark plug 113 to ignite fuel. A more specific configuration of the coil unit 103 and a method of connection between the coil unit 103 and each part of the ignition device 1 will be described later.

The igniter 104 is a circuit board connected to the primary coil L1. The igniter 104 is electrically connected to the ECU 105 and receives a signal from the ECU 105. The signal received from the ECU 105 will hereinafter be called an "EST signal." The igniter 104 includes the first switch 71, the second switch 72, and a driving IC 73. The igniter 104 may be integrated with an electronic circuit of the ECU 105.

For example, an insulated-gate bipolar transistor (IGBT) is used as each of the first switch 71 and the second switch 72. The first switch 71 is interposed between the main primary coil 51 of the primary coil L1 and the ground. The first switch 71 has a collector (C) connected to the main primary coil 51. The first switch 71 has an emitter (E) connected to the ground. The first switch 71 has a gate (G) connected to the driving IC 73. By doing so, the first switch 71 becomes functional to switch between passage and interruption of the primary current I1*a* flowing from the battery 102 into the ground through the main primary coil 51.

The second switch 72 is interposed between the auxiliary primary coil 52 of the primary coil L1 and the ground. The second switch 72 has a collector (C) connected to the auxiliary primary coil 52. The second switch 72 has an emitter (E) connected to the ground. The second switch 72 has a gate (G) connected to the driving IC 73. By doing so, the second switch 72 becomes functional to switch between passage and interruption of the primary current I1*b* flowing from the battery 102 into the ground through the auxiliary primary coil 52. A different type of transistor may be used for forming the first switch 71 and the second switch 72.

The driving IC 73 is a controller that controls opening and closing of each of the first switch 71 and the second switch 72 on the basis of an EST signal received from the ECU 105. The driving IC 73 includes a logical device connected to the first switch 71 and the second switch 72. Examples of the logical device include a logic circuit, a processor, a complex programmable logic device (CPLD), a field-programmable gate array (FPGA), and an application-specific integrated circuit (ASIC). The logical device performs operation processing for putting the ignition device 1 into operation and igniting the spark plug 113.

When the first switch 71 is closed, the primary current I1*a* flows from the battery 102 into the main primary coil 51. When the first switch 71 is opened, the primary current I1*a* flowing in the main primary coil 51 is interrupted. When the second switch 72 is closed, the primary current I1*b* flows in the auxiliary primary coil 52. When the second switch 72 is opened, the primary current I1*b* flowing in the auxiliary primary coil 52 is interrupted.

The ECU 105 is an existing computer that controls the motions of a transmission, an air bag, etc. of the vehicle body 100 comprehensively.

<1-2. Specific Configuration of Coil Unit and Method of Connection Between Coil Unit and Each Part of Ignition Device>

A more specific configuration of the coil unit 103 and a method of connection between the coil unit 103 and each part of the ignition device 1 will be described next.

As described above, the coil unit 103 includes the bobbin 40, the primary coil L1, the secondary coil L2, and the iron core 60. As shown in FIG. 2, the iron core 60 has a configuration with a center iron core 601 and an outer iron core 602 combined together. Each of the center iron core 601 and the outer iron core 602 is formed of a stacked steel plate with a stack of silicon steel plates, for example. The center iron core 601 is arranged inside the primary coil L1 in the radial direction and extends in the axis direction. The outer iron core 602 is arranged external to the secondary coil L2 in the radial direction and connects the opposite ends of the center iron core 601 in the axis direction. In this way, the iron core 60 forms a closed magnetic circuit configuration in which the primary coil L1 and the secondary coil L2 are electromagnetically coupled to each other. In the coil unit 103, the main primary coil 51 and the auxiliary primary coil 52 are excited independently of each other so as to generate magnetic fields of different poles.

Figure 3:
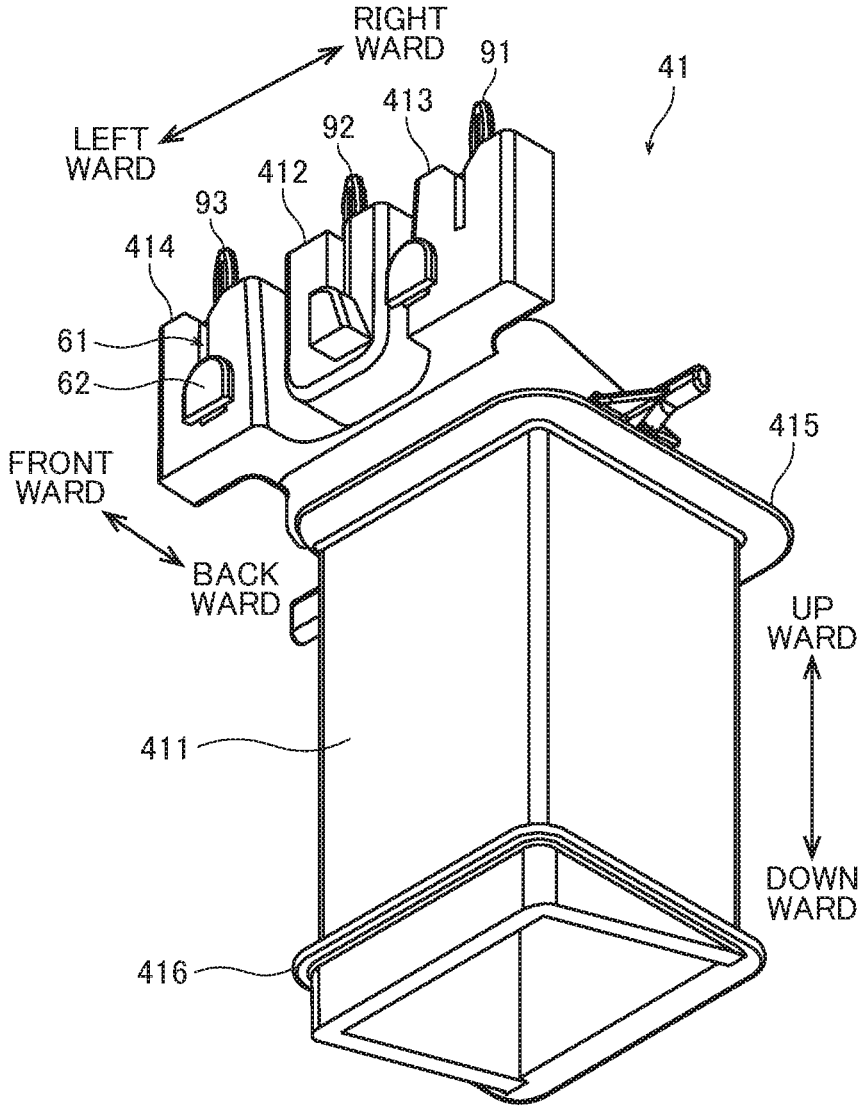
FIGS. 3 and 4 are perspective views of a primary bobbin according to the first preferred embodiment.
Figure 4:
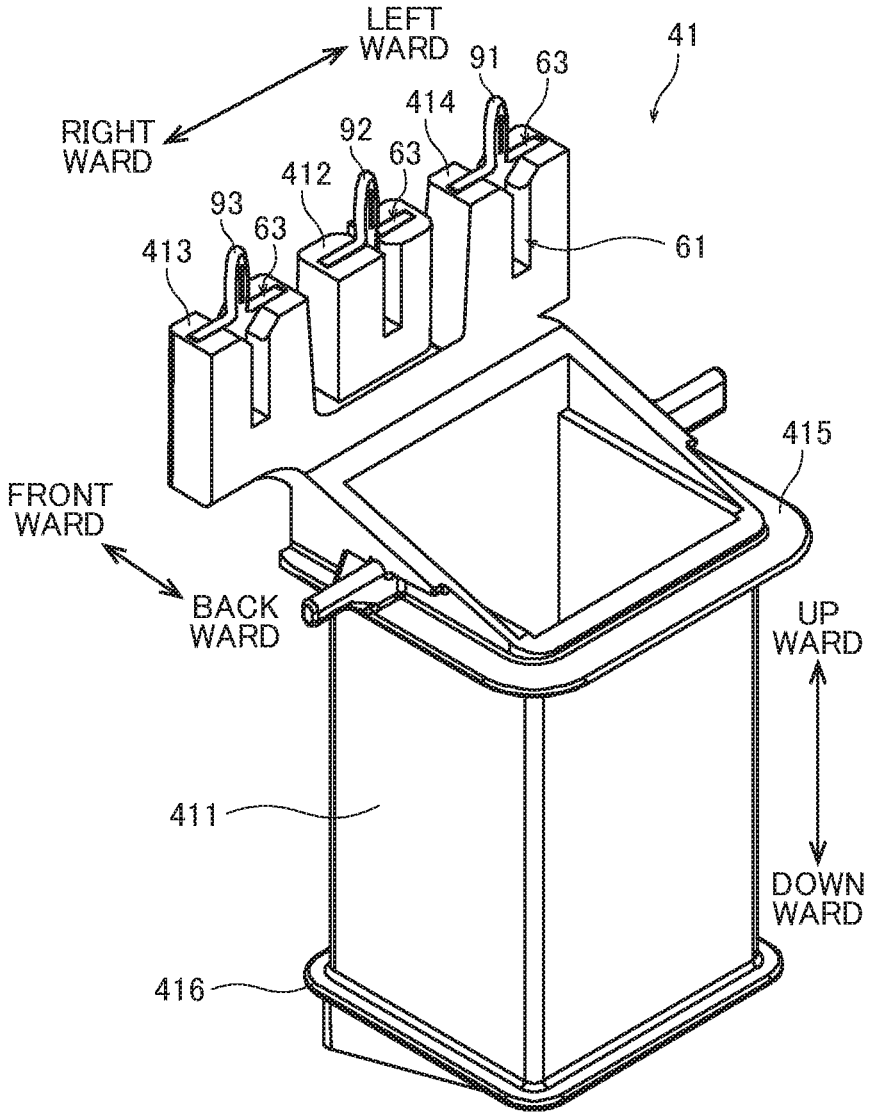

The bobbin 40 includes a primary bobbin 41 and a secondary bobbin 42. Each of the primary bobbin 41 and the secondary bobbin 42 extends in a tubular shape in the axis direction. The secondary bobbin 42 is arranged external to the primary bobbin 41 in the radial direction. The primary bobbin 41 and the secondary bobbin 42 are made of resin, for example. FIGS. 3 and 4 are perspective views of the primary bobbin 41. As shown in FIGS. 2 to 4, the primary bobbin 41 includes a bobbin body 411, a hooking part 412, a first protrusion 413, and a second protrusion 414.

The bobbin body 411 extends in a tubular shape around the center iron core 601 forming a part of the iron core 60. The hooking part 412, the first protrusion 413, and the second protrusion 414 each protrude upward further from the vicinity of the upper end of the bobbin body 411. Of the hooking part 412, the first protrusion 413, and the second protrusion 414, the hooking part 412 is provided at the center in a right-left direction (see FIGS. 2 to 4). The first protrusion 413 is arranged next to and on the right side of the hooking part 412 at an interval from the hooking part 412. The second protrusion 414 is arranged next to and on the left side of the hooking part 412 at an interval from the hooking part 412. However, these are not the only positions of the hooking part 412, the first protrusion 413, and the second protrusion 414 relative to each other. The hooking part 412, the first protrusion 413, and the second protrusion 414 are each required only to protrude from a part of the bobbin body 411. The first protrusion 413 is required only to be next to the hooking part 412 on one side at an interval from the hooking part 412. The second protrusion 414 is required only to be next to the hooking part 412 on the other side at an interval from the hooking part 412.

As shown in FIGS. 2 to 4, the hooking part 412, the first protrusion 413, and the second protrusion 414 each include a groove 61, a winding part 62, and a terminal attachment recess 63. The groove 61 is recessed downward from the upper surface of each of the hooking part 412, the first protrusion 413, and the second protrusion 414, and penetrates each of the hooking part 412, the first protrusion 413, and the second protrusion 414 in a front-back direction. The front-back direction is a direction perpendicular to the up-down direction and the right-left direction. The winding part 62 protrudes frontward further from the front surface of each of the hooking part 412, the first protrusion 413, and the second protrusion 414. The terminal attachment recess 63 is recessed downward from the upper surface of each of the hooking part 412, the first protrusion 413, and the second protrusion 414, and communicates with the groove 61. The terminal attachment recess 63 extends further than the groove 61 in the right-left direction.

The primary bobbin 41 is provided with an upper flange 415 and a lower flange 416. The upper flange 415 protrudes externally in the radial direction from the outer peripheral surface of the bobbin body 411 and from the vicinity of the upper end of the bobbin body 411. The lower flange 416 protrudes externally in the radial direction from the outer peripheral surface of the bobbin body 411 and from the vicinity of the lower end of the bobbin body 411.

The primary coil L1 is formed by winding a conductor on the primary bobbin 41. This conductor wound on the primary bobbin 41 will hereinafter be called a "primary conductor 81." The primary conductor 81 is made of a metal wire covered by a resin coating having insulating properties. This metal wire has a diameter φ from about 0.4 to about 1.0 mm, for example. Three metal terminals including a winding start terminal 91, an intermediate terminal 92, and a winding finish terminal 93 are connected to the primary conductor 81.

Figure 5:
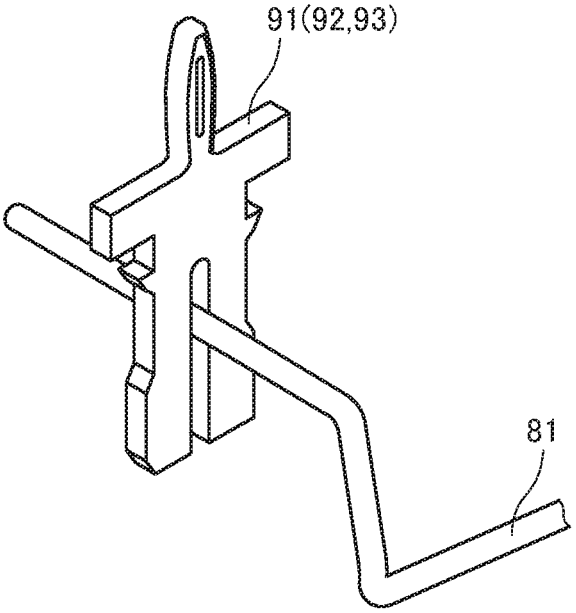
FIG. 5 is a perspective view showing how a terminal is fixed to a primary conductor according to the first preferred embodiment.

FIG. 5 is a perspective view showing how one terminal (winding start terminal 91, for example) is fixed to the primary conductor 81. As shown in FIG. 5, a part of the winding start terminal 91 has a grasping structure formed into a shape like scissors. The winding start terminal 91 catches the primary conductor 81 with the grasping structure and contacts the metal wire under pressure while penetrating the insulating coating of the primary conductor 81. By doing so, the winding start terminal 91 becomes electrically continuous with the metal wire of the primary conductor 81 while being fixed to the primary conductor 81. Each of the intermediate terminal 92 and the winding finish terminal 93 has a similar configuration to the winding start terminal 91. Namely, each of the intermediate terminal 92 and the winding finish terminal 93 catches the primary conductor 81 with its grasping structure and contacts the metal wire under pressure while penetrating the insulating coating of the primary conductor 81. By doing so, each of the intermediate terminal 92 and the winding finish terminal 93 becomes electrically continuous with the metal wire of the primary conductor 81 while being fixed to the primary conductor 81.

Figure 6:
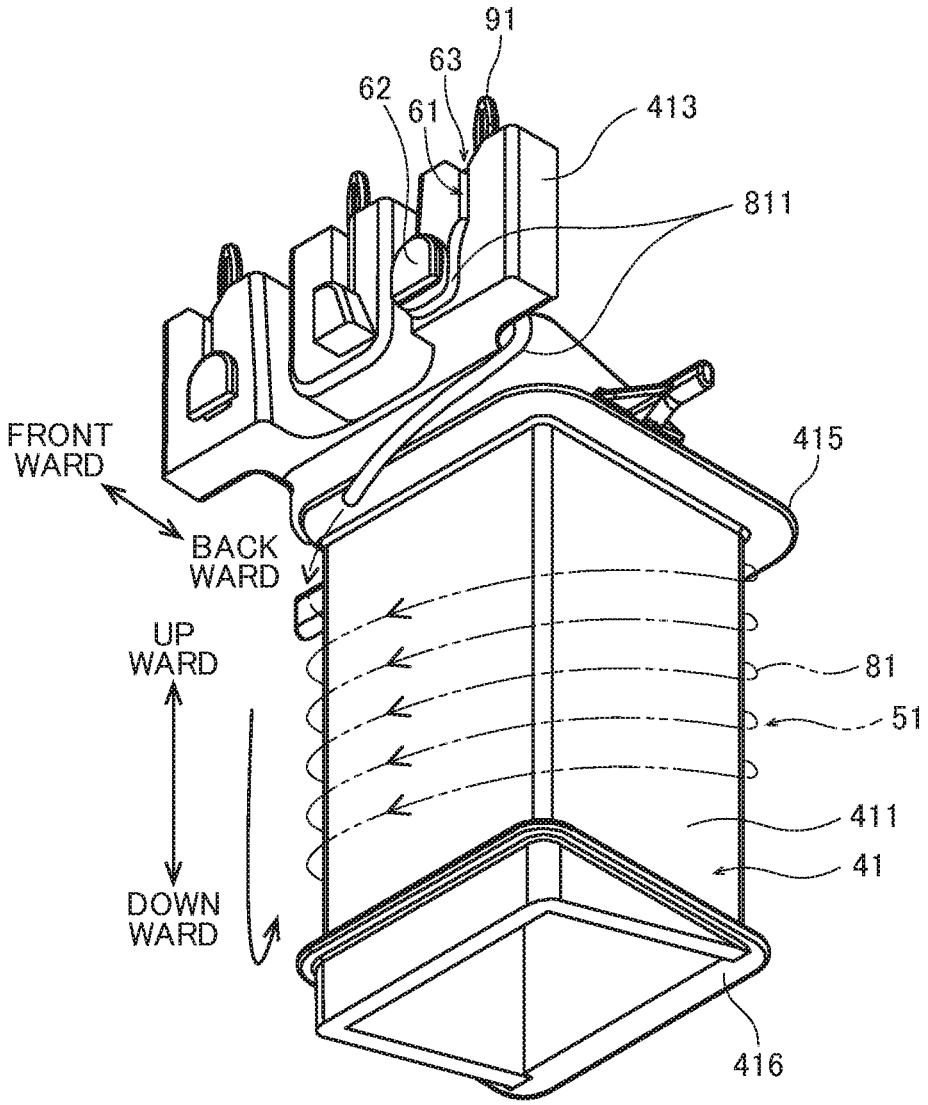
FIG. 6 is a perspective view showing how a winding start end of the primary conductor is wound on the primary bobbin according to the first preferred embodiment.
Figure 7:
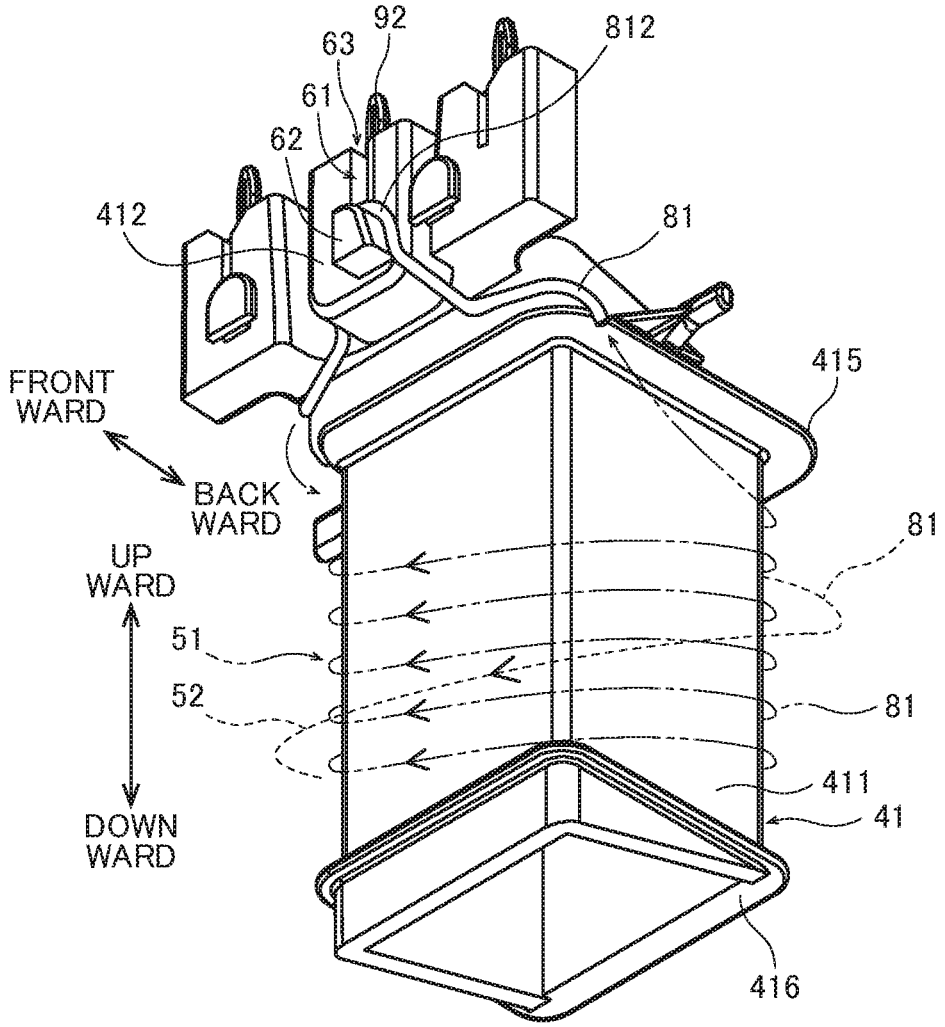
FIG. 7 is a perspective view showing how an intermediate section of the primary conductor is wound on the primary bobbin according to the first preferred embodiment.
Figure 8:
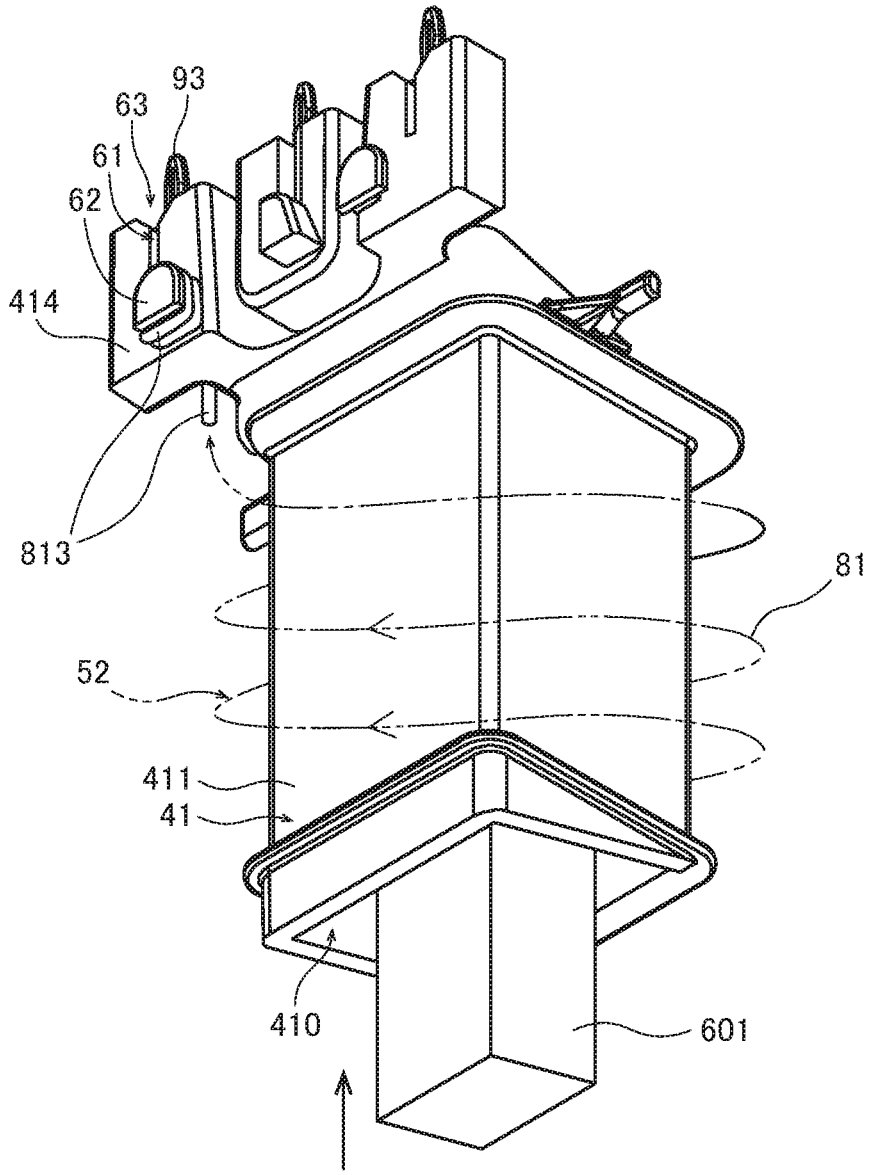
FIG. 8 is a perspective view showing how a winding finish end of the primary conductor is wound on the primary bobbin according to the first preferred embodiment.

FIGS. 6 to 8 are perspective views each showing how the primary conductor 81 is wound on the primary bobbin 41. FIG. 6 shows only a section of the primary conductor 81 at the beginning and its vicinity where the primary conductor 81 starts to be wound on the primary bobbin 41, and a part of the primary conductor 81 forming the main primary coil 51 is indicated by lines with alternate long and two short dashes. The section of the primary conductor 81 at the beginning and its vicinity where the primary conductor 81 starts to be wound on the primary bobbin 41 will hereinafter be called a "winding start end 811." FIG. 7 shows only the intermediate section 812 described above and its vicinity of the primary conductor 81, and a part of the primary conductor 81 forming the main primary coil 51 is indicated by lines with alternate long and two short dashes. In FIG. 7, a part of the primary conductor 81 forming the auxiliary primary coil 52 is partially indicated by dashes. FIG. 8 shows only a section of the primary conductor 81 at the termination and its vicinity where winding of the primary conductor 81 on the primary bobbin 41 is finished, and a part of the primary conductor 81 forming the auxiliary primary coil 52 is indicated by lines with alternate long and two short dashes. The section of the primary conductor 81 at the termination and its vicinity where winding of the primary conductor 81 on the primary bobbin 41 is finished will hereinafter be called a "winding finish end 813."

As shown in FIG. 6, for winding of the primary conductor 81 on the primary bobbin 41, the winding start terminal 91 is first fixed to the winding start end 811 of the primary conductor 81, and then the winding start end 811 is tied to the winding part 62 of the first protrusion 413. Next, the winding start terminal 91 is fitted in the terminal attachment recess 63 of the first protrusion 413. Further, the primary conductor 81 fixed to the winding start terminal 91 is passed through the groove 61 of the first protrusion 413 from the front toward the back. By doing so, the winding start end 811 of the primary conductor 81 is fixed to the primary bobbin 41 and becomes less likely to be detached.

Next, the primary conductor 81 is wound in the peripheral direction on the outer peripheral surface of the bobbin body 411. In the first preferred embodiment, the primary conductor 81 is wound on the outer peripheral surface of the bobbin body 411 in the clockwise direction, namely, in the right-handed screw direction as viewed from above. While the primary conductor 81 is wound at uniform intervals in the axis direction on the outer peripheral surface of the bobbin body 411, the primary conductor 81 is moved downward from above and is moved further upward from below between the upper flange 415 and the lower flange 416. By doing so, the primary conductor 81 is wound on the outer peripheral surface of the bobbin body 411 without generating substantially no gap to finish formation of the main primary coil 51.

Next, as shown in FIG. 7, the intermediate terminal 92 is fixed to the intermediate section 812 of the primary conductor 81 downstream from the main primary coil 51. Then, a part of the intermediate section 812 is hooked on the winding part 62 of the hooking part 412. Next, the intermediate terminal 92 is fitted in the terminal attachment recess 63 of the hooking part 412. Further, the primary conductor 81 fixed to the intermediate terminal 92 is passed through the groove 61 of the hooking part 412 from the front toward the back. By doing so, the intermediate section 812 of the primary conductor 81 is fixed to the primary bobbin 41 and becomes less likely to be detached.

A radius of curvature is smaller at the section of the primary conductor 81 hooked on the hooking part 412 than at the other section of the primary conductor 81. In the first preferred embodiment, a radius of curvature at the section on the hooking part 412 is preferably equal to or more than R2 (2 mm). In particular, in consideration of the size of the hooking part 412, a radius of curvature at this section is desirably equal to or more than R2 (2 mm) and equal to or less than R7 (7 mm). Winding the primary conductor 81 on the primary bobbin 41 while maintaining a large radius of curvature of the metal wire makes it possible to prevent damage or break due to local load to be applied excessively on the primary conductor 81 including the metal wire.

After the intermediate section 812 of the primary conductor 81 is hooked on the hooking part 412, the primary conductor 81 is turned in a U-shape toward the bobbin body 411 and wound on the outer peripheral surface of the main primary coil 51 to be pointed to the same direction as the main primary coil 51 in the peripheral direction. Namely, the primary conductor 81 is wound in the clockwise direction, namely, in the right-handed screw direction as viewed from above. While the primary conductor 81 is wound at uniform intervals in the axis direction on the outer peripheral surface of the main primary coil 51, the primary conductor 81 is moved downward from above and is moved further upward from below between the upper flange 415 and the lower flange 416. By doing so, the primary conductor 81 is stacked external to the main primary coil 51 in the radial direction to finish formation of the auxiliary primary coil 52.

The number of turns of the main primary coil 51 wound on the bobbin body 411 is larger than that of the auxiliary primary coil 52. This allows the auxiliary primary coil 52 to be wound in an aligned manner external to the main primary coil 51 in the radial direction to reduce the occurrence of a level difference or deviation.

Next, as shown in FIG. 8, the winding finish terminal 93 is fixed to the winding finish end 813 of the primary conductor 81 downstream from the auxiliary primary coil 52, and then the winding finish end 813 is tied to the winding part 62 of the second protrusion 414. Next, the winding finish terminal 93 is fitted in the terminal attachment recess 63 of the second protrusion 414. Further, the primary conductor 81 fixed to the winding finish terminal 93 is passed through the groove 61 of the second protrusion 414 from the front toward the back. By doing so, the winding finish end 813 of the primary conductor 81 is fixed to the primary bobbin 41 and becomes less likely to be detached. Tension is applied to the primary conductor 81 between the winding start end 811 and the winding finish end 813 to reduce the occurrence of deviation or detachment of the primary conductor 81 further. As a result, formation of the primary coil L1 is finished.

After formation of the primary coil L1 is finished, the secondary bobbin 42 is arranged to cover the outer peripheral surface of the primary coil L1, as shown in FIG. 2. Then, the secondary conductor 82 different from the primary conductor 81 is wound on the outer peripheral surface of the secondary bobbin 42 to form the secondary coil L2. The secondary conductor 82 has a diameter ci from about 0.04 to about 0.08 mm. The number of turns of the secondary conductor 82 of the secondary coil L2 is about 100 times or more the number of turns of the primary conductor 81 of the primary coil L1. For example, the number of turns of the secondary conductor 82 is 10000, and the number of turns of the primary conductor 81 is 100. With this configuration, a high voltage is induced in the secondary coil L2 during the operation of the ignition device 1 as described later. Further, the primary coil L1 and the secondary coil L2 are arranged to be stacked on each other in the radial direction to achieve size reduction of the coil unit 103 in its entirety including the primary coil L1 and the secondary coil L2.

In the first preferred embodiment, the secondary conductor 82 is wound on the outer peripheral surface of the secondary bobbin 42 in the clockwise direction, namely, in the right-handed screw direction as viewed from above. Then, an end of the secondary conductor 82 upstream of the winding direction is connected to the spark plug 113, and an end of the secondary conductor 82 downstream of the winding direction is connected to the ground. However, this is not the only direction of winding the secondary conductor 82. The direction of winding the secondary conductor 82 can be selected appropriately in a manner that depends on a direction of winding the primary conductor 81 or a method connection to each part.

Next, as shown in FIG. 8, the center iron core 601 is passed through space 410 inside the bobbin body 411 of the primary bobbin 41 in the radial direction. Then, the center iron core 601 is combined with the outer iron core 602 to form the iron core 60.

As shown in FIG. 2, a part of the winding start terminal 91 different from a part to which the primary conductor 81 is fixed is connected to the first switch 71 indirectly through a conductor provided separately, for example. Alternatively, the winding start terminal 91 may be connected to the first switch 71 directly without intervention of a conductor, for example.

A part of the intermediate terminal 92 different from a part to which the primary conductor 81 is fixed is connected to the battery 102 indirectly through the power supply line 150. By doing so, a DC voltage is applied to the intermediate section 812 of the primary conductor 81 between the main primary coil 51 and the auxiliary primary coil 52. Alternatively, the intermediate terminal 92 may be connected to the battery 102 directly without intervention of the power supply line 150 or a different power supply cable.

Also, a part of the winding finish terminal 93 different from a part to which the primary conductor 81 is fixed is connected to the second switch 72 indirectly through a conductor provided separately, for example. Alternatively, the winding finish terminal 93 may be connected to the second switch 72 directly without intervention of a conductor, for example.

As described above, in the present invention, the primary coil L1 is formed by stacking the main primary coil 51 and the auxiliary primary coil 52 on each other each formed by winding the single primary conductor 81 on the primary bobbin 41. This eliminates the need for winding the main primary coil 51 and the auxiliary primary coil 52 separately on the primary bobbin 41, or the need for connecting the opposite ends of the main primary coil 51 and the opposite ends of the auxiliary primary coil 52 to corresponding parts in the ignition device 1. As a result, working efficiency during the manufacturing process is increased. Further, the size of the coil unit in its entirety including the main primary coil 51 and the auxiliary primary coil 52 is reduced, compared to a case of winding the main primary coil 51 and the auxiliary primary coil 52 separately. Additionally, a volume of the primary coil L1 used for forming the primary conductor 81 is reduced, thereby encouraging cost reduction.

In the first preferred embodiment, the hooking part 412, the first protrusion 413, and the second protrusion 414 are arranged side by side on one side of the bobbin body 411 in the axis direction. In the first preferred embodiment, the hooking part 412, the first protrusion 413, and the second protrusion 414 are arranged on the upper side of the bobbin body 411. This encourages increased efficiency in the work of connection to each part in the ignition device 1. Regarding the parts in the ignition device 1 other than the coil unit 103, and the secondary coil L2 and the iron core 60 in the coil unit 103, these parts are compatible with existing parts so the existing parts are also applicable to the ignition device 1 of the present invention, thereby encouraging cost reduction.

As shown in FIG. 1, in the first preferred embodiment, the secondary coil L2 has the other end on the opposite side of the one end to which the spark plug 113 is connected, and a diode 114 is connected further to the other end in series with the secondary coil L2 in such a manner that a direction toward the ground is a forward direction. This prevents an induced current resulting from a voltage induced in the secondary coil L2 by the gradually increasing primary current I1 (primary current I1*a*) from flowing in the reverse direction toward the spark plug 113.

<1-3. Procedure of Operation of Coil Unit>

A procedure of the operation of the coil unit 103 will be described next.

As described above, in the primary coil L1 of the first preferred embodiment, the intermediate section 812 of the primary conductor 81 is located between the main primary coil 51 and the auxiliary primary coil 52. A DC voltage (B+) from the battery 102 is applied to the intermediate section 812. The winding start end 811 of the primary conductor 81 is connected to the first switch 71. The winding finish end 813 of the primary conductor 81 is connected to the second switch 72.

As described above, the main primary coil 51 and the auxiliary primary coil 52 are wound on the outer peripheral surface of the bobbin body 411 to be pointed to the same direction in the peripheral direction. In the first preferred embodiment, the primary conductor 81 is wound in the clockwise direction, namely, in the right-handed screw direction as viewed from above at each of the main primary coil 51 and the auxiliary primary coil 52. Thus, when each of the first switch 71 and the second switch 72 is closed, applying the DC voltage (B+) to the intermediate section 812 of the primary conductor 81 causes the primary current I1*a* in the main primary coil 51 and the primary current I1*b* in the auxiliary primary coil 52 to flow in directions opposite to each other (see FIGS. 9 and 11 referred to later).

Figure 9:
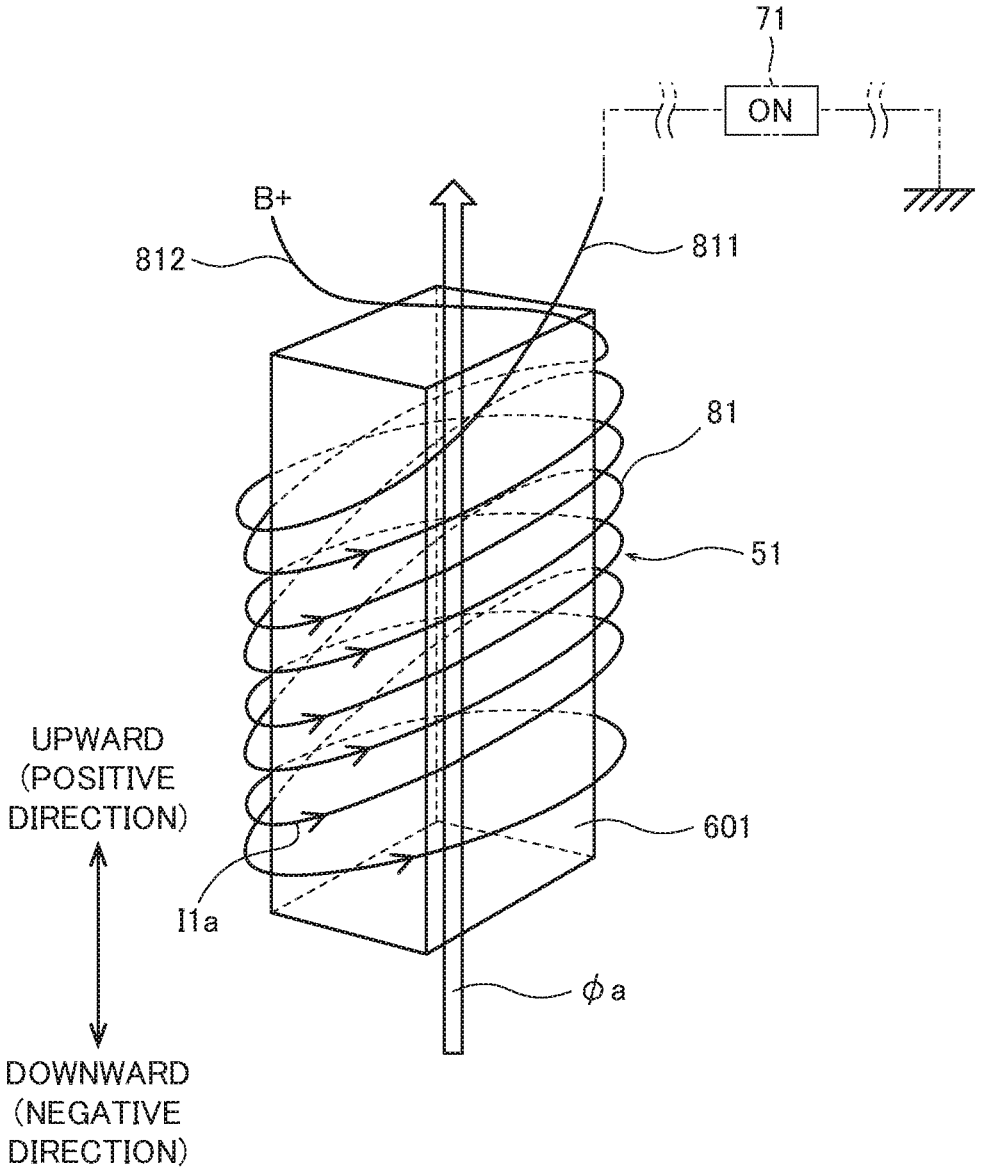
FIG. 9 is a perspective view schematically showing the direction of magnetic flux during current passage control according to the first preferred embodiment.

As described above, the driving IC 73 controls opening and closing of each of the first switch 71 and the second switch 72 on the basis of an EST signal received from the ECU 105. For putting the coil unit 103 into operation, the driving IC 73 first closes the first switch 71 and opens the second switch 72. At this time, in the primary conductor 81, the primary current I1*a* flows from the intermediate section 812 toward only the main primary coil 51. FIG. 9 is a perspective view schematically showing the direction of the primary current I1*a* in the main primary coil 51 flowing at this time and the direction of magnetic flux generated at this time. As indicated by arrows in FIG. 9, the primary current I1*a* flows in the main primary coil 51 in the anticlockwise direction, namely, in the left-handed screw direction as viewed from above. By the flow of the primary current I1*a* in the main primary coil 51, current passage magnetic flux φa in an upward direction indicated by a hollow arrow in FIG. 9 is generated, and a magnetic field responsive to the generated magnetic flux acts on the center iron core 601 (current passage control). The upward direction and a downward direction in FIG. 9 and FIGS. 10 and 11 referred to later will be called a "positive direction" and a "negative direction" respectively.

Figure 10:
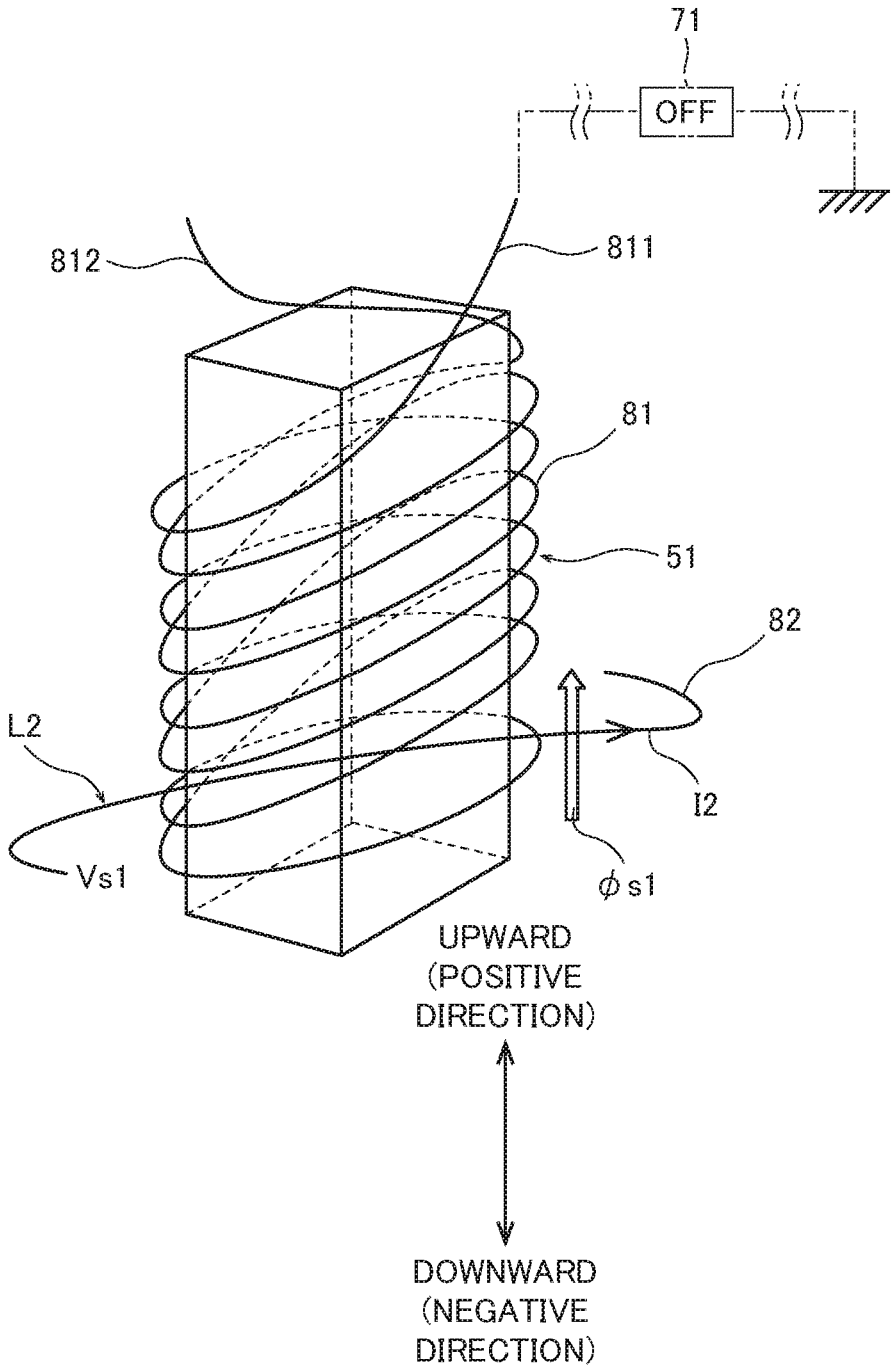
FIG. 10 is a perspective view schematically showing the direction of magnetic flux during interruption control according to the first preferred embodiment.

Next, the driving IC 73 changes the first switch 71 in the closed state to an open state while maintaining the second switch 72 in the open state (interruption control) at the timing when a predetermine period of time T has passed from start of the current passage control described above. FIG. 10 is a perspective view schematically showing the direction of a secondary current I2 in the secondary coil L2 flowing at this time and the direction of magnetic flux generated at this time. As shown in FIG. 10, at this time, the primary current I1*a* is interrupted, and the current passage magnetic flux φa in the positive direction generated in the current passage control described above changes to be reduced. Then, mutual induction action is generated in the secondary conductor 82 of the secondary coil L2 arranged external to the primary conductor 81 in the radial direction to cause the secondary current I2 to flow in a direction indicated by an arrow in FIG. 10. Then, interruption magnetic flux φs1 is generated in a direction in which change in the current passage magnetic flux φa is hindered, namely, in a direction indicated by a hollow arrow in FIG. 10 to generate induced electromotive force Vs1 in the secondary coil L2.

Figure 11:
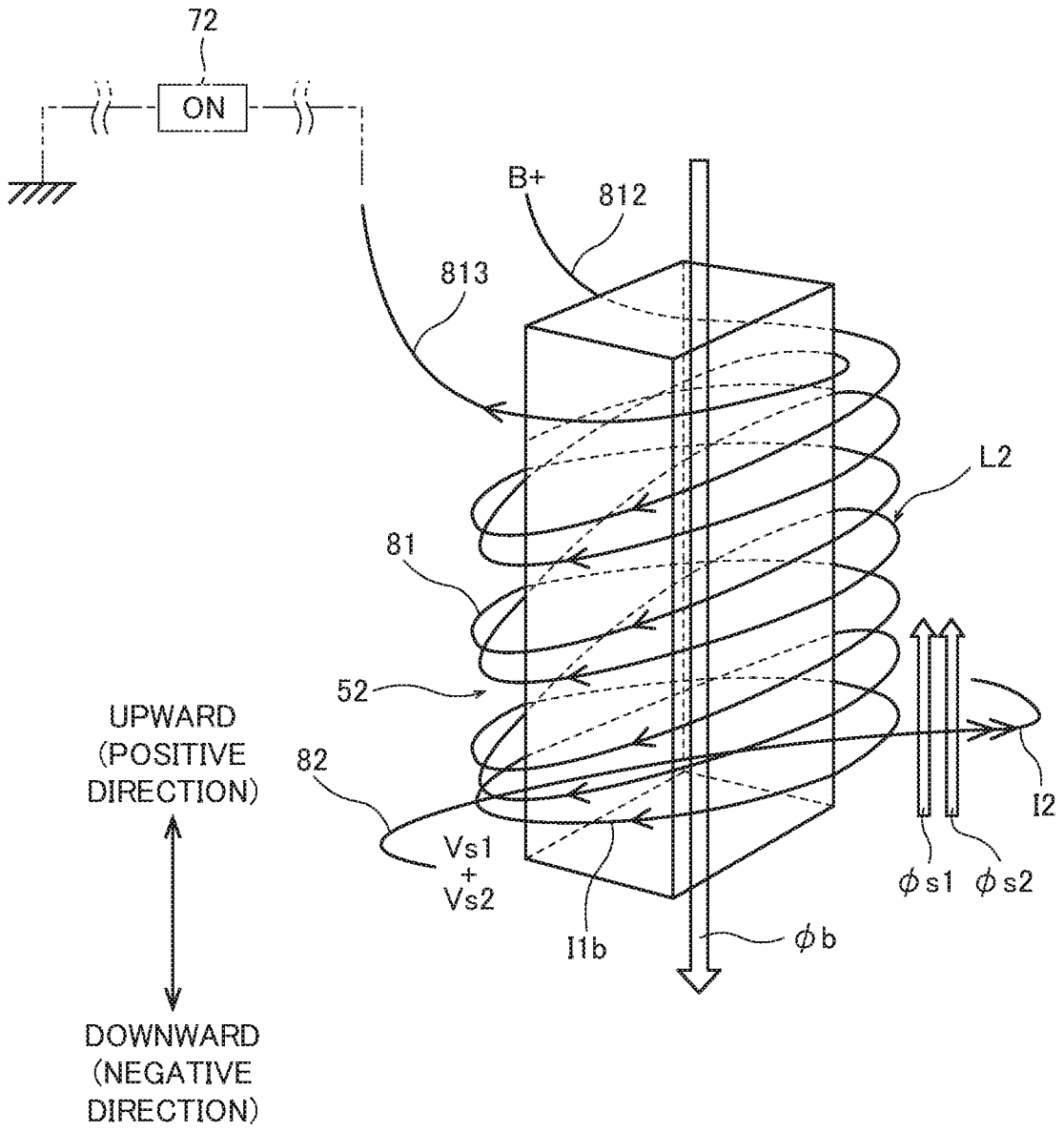
FIG. 11 is a perspective view schematically showing the direction of magnetic flux during current superimposition control according to the first preferred embodiment.

Simultaneously with start of the interruption control described above, the driving IC 73 changes the second switch 72 in the open state to a closed state. This causes the primary current I1*b* to flow from the intermediate section 812 toward only the auxiliary primary coil 52 in the primary conductor 81. FIG. 11 is a perspective view schematically showing the direction of the primary current I1*b* in the auxiliary primary coil 52 flowing at this time and the direction of magnetic flux generated at this time. As indicated by arrows in FIG. 11, the primary current I1*b* flows in the auxiliary primary coil 52 in the clockwise direction, namely, in the right-handed screw direction as viewed from above. By the flow of the primary current I1*b* in the auxiliary primary coil 52, current passage magnetic flux φb in the downward direction indicated by a hollow arrow in FIG. 11 is generated, and a magnetic field responsive to the generated magnetic flux acts on the center iron core 601. Then, mutual induction action is generated in the secondary conductor 82 of the secondary coil L2 arranged external to the primary conductor 81 in the radial direction to cause a larger secondary current I2 to flow in a direction indicated by arrows in FIG. 11. Then, in addition to the interruption magnetic flux φs1 described above, superimposition magnetic flux φs2 is generated in a direction in which the current passage magnetic flux φb is hindered, namely, in a direction indicated by a hollow arrow in FIG. 11 to induce superimposition electromotive force Vs2 in the secondary coil L2 (superimposition control) in addition to the induced electromotive force Vs1 described above.

In this way, electromotive force generated in the secondary coil L2 is increased by the superimposition to generate a high voltage. This allows generation of an electric spark at the spark plug 113 to ignite fuel. After discharge occurs sufficiently at the spark plug 113, the second switch 72 in the closed state is changed to an open state to interrupt the primary current I1*b* flowing toward the auxiliary primary coil 52.

The driving IC 73 may change the second switch 72 in the open state to a closed state at the timing when a tiny period of time Δt has passed from a moment when the interruption control described above is started, namely, from a moment when the first switch 71 in the closed state is changed to an open state. For example, the driving IC 73 may change the second switch 72 in the open state to a closed state at the timing when some milliseconds have passed from a moment when the interruption control described above is started. This generates a time lag between timing of generation of the induced electromotive force Vs1 described above in the secondary coil L2 and timing of induction of the superimposition electromotive force Vs2 described above in the secondary coil L2 to allow supply of discharge energy for a longer period of time to the spark plug 113. In this way, discharge is maintained for a longer period of time at the spark plug 113.

2. Modifications

While the exemplary preferred embodiment of the present invention has been described hereinabove, the present invention is not limited to the foregoing preferred embodiment.

In the preferred embodiment described above, each of the main primary coil 51 and the auxiliary primary coil 52 is formed by being wound on the outer peripheral surface of the bobbin body 411 in the clockwise direction, namely, in the right-handed screw direction as viewed from above. As long as the main primary coil 51 and the auxiliary primary coil 52 are wound on the outer peripheral surface of the bobbin body 411 to be pointed to the same direction in the peripheral direction, each of the main primary coil 51 and the auxiliary primary coil 52 may be wound in the anticlockwise direction, namely, in the left-handed screw direction as viewed from above.

In the preferred embodiment described above, in the primary coil L1, the auxiliary primary coil 52 is stacked on the main primary coil 51 to be external to the main primary coil 51 in the radial direction. Alternatively, in the primary coil L1, the main primary coil 51 may be stacked on the auxiliary primary coil 52 to be external to the auxiliary primary coil 52 in the radial direction. Namely, what is required in the primary coil L1 is to stack one of the main primary coil 51 and the auxiliary primary coil 52 on the other of the main primary coil 51 and the auxiliary primary coil 52 to be external to the other primary coil in the radial direction.

The ignition device of the present invention is any device installable on various types of devices or industrial machines such as power generators in addition to vehicles such as automobiles, and available for use for igniting fuel by generating electric sparks at spark plugs of internal combustion engines.

The detailed shape or configuration of the ignition device including the coil unit described above can be changed appropriately within a range without deviating from the purport of the present invention. Additionally, the foregoing elements in the embodiment or modifications described above may be combined together, as appropriate, without inconsistencies.

What is claimed is:

1. An ignition device for use in an internal combustion engine comprising:

a coil unit with a primary coil, a secondary coil, and an iron core, said primary coil including a main primary coil and an auxiliary primary coil formed by winding a single primary conductor on a primary bobbin, said secondary coil being formed by winding a secondary conductor on a secondary bobbin, said iron core electromagnetically coupling said primary coil and said secondary coil, said coil unit receiving a DC voltage from a power supply at an intermediate section of said primary conductor between said main primary coil and said auxiliary primary coil;

a first switch interposed between said main primary coil and the ground and usable for switching between passage and interruption of a primary current flowing from said power supply into said main primary coil;

a second switch interposed between said auxiliary primary coil and the ground and usable for switching between passage and interruption of a primary current flowing from said power supply into said auxiliary primary coil; and a controller that controls said first switch and said second switch, said primary bobbin including:

a bobbin body extending in a tubular shape around a part of said iron core; and a hooking part protruding from a part of said bobbin body, said main primary coil and said auxiliary primary coil being wound on an outer peripheral surface of said bobbin body to be pointed to the same direction in a peripheral direction, and one of said main primary coil and said auxiliary primary coil being stacked on the other of said main primary coil and said auxiliary primary coil to be external to the other primary coil in a radial direction, at least a part of said intermediate section being hooked on said hooking part.

2. The ignition device according to claim 1, wherein said controller performs:

current passage control of causing said primary current to flow in said main primary coil by placing said first switch in a closed state and placing said second switch in an open state;

interruption control of changing said first switch to an open state after said primary current flows in said main primary coil; and superimposition control of changing said second switch to a closed state simultaneously with a moment when said first switch is changed to an open state or after passage of a tiny period of time from a moment when said first switch is changed to an open state.

3. The ignition device according to claim 2, wherein the number of turns of said main primary coil is larger than that of said auxiliary primary coil, and said auxiliary primary coil is stacked on said main primary coil to be external to said main primary coil in said radial direction.

4. The ignition device according to claim 1, wherein said primary conductor includes a metal wire covered by a resin coating having insulating properties, said ignition device further comprises a metal terminal fixed to said intermediate section, and a part of said terminal contacts said metal wire under pressure while penetrating said coating, and a different part of said terminal is connected to said power supply directly or indirectly.

5. The ignition device according to claim 1, wherein said part of said intermediate section hooked on said hooking part has a radius of curvature equal to or more than R2 and equal to or less than R7.

6. The ignition device according to claim 1, wherein said primary bobbin further includes:

a first protrusion protruding from a part of said bobbin body and next to said hooking part on one side at an interval from said hooking part; and a second protrusion protruding from a part of said bobbin body and next to said hooking part on the other side at an interval from said hooking part, and a winding start end of said primary conductor is tied to said first protrusion and a winding finish end of said primary conductor is tied to said second protrusion.

7. The ignition device according to claim 4, further comprising:

a metal winding start terminal fixed to a winding start end of said primary conductor; and a metal winding finish terminal fixed to a winding finish end of said primary conductor, wherein a part of said winding start terminal contacts said metal wire under pressure while penetrating said coating, and a different part of said winding start terminal is connected to said first switch directly or indirectly, and a part of said winding finish terminal contacts said metal wire under pressure while penetrating said coating, and a different part of said winding finish terminal is connected to said second switch directly or indirectly.

8. The ignition device according to claim 1, wherein said secondary bobbin covers an outer peripheral surface of said primary coil.

9. The ignition device according to claim 1, wherein each of said primary bobbin and said secondary bobbin is made of resin.

10. The ignition device according to claim 1, wherein said secondary coil has one end to which a diode is connected in such a manner that a direction toward the ground is a forward direction.

* * * * *